US011812844B2

(12) United States Patent
Salentine et al.

(10) Patent No.: US 11,812,844 B2
(45) Date of Patent: Nov. 14, 2023

(54) MULTIPLE MAGNET CONNECTION MECHANISM FOR RETRACTORS

(71) Applicant: HAMMERHEAD INDUSTRIES, INC., Ventura, CA (US)

(72) Inventors: John A. Salentine, Goleta, CA (US); Kenneth S. Collin, Jr., Ojai, CA (US)

(73) Assignee: HAMMERHEAD INDUSTRIES, INC.

( * ) Notice: Subject to any disclaimer, the term of this patent is extended or adjusted under 35 U.S.C. 154(b) by 0 days.

(21) Appl. No.: 17/010,654

(22) Filed: Sep. 2, 2020

(65) Prior Publication Data

US 2021/0186189 A1 Jun. 24, 2021

Related U.S. Application Data

(60) Provisional application No. 62/895,928, filed on Sep. 4, 2019.

(51) Int. Cl.
*A45F 5/00* (2006.01)
*A45C 13/10* (2006.01)

(52) U.S. Cl.
CPC ..... *A45F 5/004* (2013.01); *A45C 13/1069* (2013.01); *A45F 2200/0516* (2013.01)

(58) Field of Classification Search
CPC .. A45F 5/00; A45F 5/004; A45F 5/021; A45F 2005/008; A45F 2200/0516; H01R 13/6205; H04B 1/3888; A45C 13/1069
See application file for complete search history.

(56) References Cited

U.S. PATENT DOCUMENTS

| | | | | |
|---|---|---|---|---|
| 9,526,321 | B1 * | 12/2016 | Nyako | H04M 1/04 |
| 2009/0229089 | A1 * | 9/2009 | Galant | A47F 7/024 24/303 |
| 2011/0309934 | A1 * | 12/2011 | Henson | G08B 13/1472 340/568.2 |
| 2014/0175135 | A1 * | 6/2014 | Paugh | H04M 1/04 224/219 |
| 2018/0028412 | A1 * | 2/2018 | Todd | A61J 1/00 |
| 2018/0293857 | A1 * | 10/2018 | Berglund | G08B 13/1454 |
| 2019/0105552 | A1 * | 4/2019 | James | A63C 7/12 |
| 2019/0235354 | A1 * | 8/2019 | Cleary | G03B 17/566 |
| 2020/0154869 | A1 * | 5/2020 | Jenkins | H04B 1/385 |
| 2020/0313346 | A1 * | 10/2020 | Hwang | H01R 13/60 |

* cited by examiner

*Primary Examiner* — Corey N Skurdal
(74) *Attorney, Agent, or Firm* — Jaye G. Heybl

(57) ABSTRACT

Connector and retractor systems are disclosed with some embodiments comprising a retractor housing and a line within the retractor housing. The housing also has a hole from which the line extends, and a spring within the retractor housing which urges retraction of the line. A personal article can be attached to the line. A connector is included between the retractor housing and the personal article, with the connector having magnets to cause alignment of the personal article with the retractor housing when the personal article is retracted to the housing.

16 Claims, 8 Drawing Sheets

MULTIPLE MAGNET CONNECTION MECHANISM FOR RETRACTORS

This application claims the benefit of U.S. Provisional Patent Application Ser. No. 62/895,928, filed on Sep. 4, 2019.

BACKGROUND OF THE INVENTION

Field of the Invention

This invention relates to retractors, and in particular, retractors having connectors with multiple magnets at facilitate alignment.

Description of the Related Art

Retracting devices have been developed for housing cables and cords such as those used, for telephones, hose reels and cellular phone earpieces. [See U.S. Pat. No. 5,094,396 to Burke, U.S. Pat. No. 5,507,446 to Ditzig and U.S. Pat. No. 4,946,010 to DiBono]. Retracting devices have also been developed having a means for removing the tethered article from the tethering device such as in the case of keys, SCUBA gear and microphones.

Personal communication devices such as cell phones can be attached or mounted to a person using different devices. In the case of cell phones some of these mounting devices include leather case with belt clips or other mechanisms for attaching to a belt. Other mounting devices can comprise a plastic holster which attaches to a belt or purse. One of the advantages of these holstering devices is that they allow for easy access and retrieval of a cell phone, pager or PDA ("personal device"). However, this advantage also results in one of their primary disadvantages. The ease of access typically prevents these mounting devices from properly securing the personal devices, which can result in their failing out under many circumstances, such as when getting in and out of a vehicle or when they are bumped. Furthermore, when the personal device is removed from these holstering devices there is no mechanism for preventing the phone from falling to the ground, if jarred or dropped from the user's hand.

A wrist lanyard has been developed which helps prevent cell phones from failing to the ground when being used. The lanyard typically comprises a rope or string that is tied or otherwise attached to the cell phone and has a loop that is large enough for a user's hand, to pass through. To secure the cell phone, the user must pass a hand through the loop when the cell phone is in the user's hand. When the cell phone is not in use, the lanyard can be tied to a belt loop. One disadvantage of this device is that when the phone is tied to a belt loop, untying the lanyard from the loop to use the phone can be awkward and inconvenient. It can also be awkward passing a hand through the loop every time the cell phone is used.

An alternate tethering device uses a spiral or coiled type lanyard, similar to the cord that is used between the receiver and telephone in older styled telephones. For cell phones the coiled, lanyard can be attached to the user at one end and attached to the phone at the other. When the phone is in use, the length of the tether can be extended and when the phone is not in use its effective length is reduced. One disadvantage of this type of tether is that to make it long so it can be conveniently used with a cell phone, the tether becomes quite long and obtrusive when the ceil phone is in the bolstered, position. The tether dangles when the phone is not in use, which can cause entanglement.

More recent arrangement have provided for tethering of the phone or other personal article to a retractor, that is then mounted to the user's body. Some of these arrangements are described in U.S. Pat. Nos. 7,665,684 and 8,794,560, both to Salentine et al., the contents of which are incorporated herein by reference. Other more recent arrangement have provided for a retractor used in conjunction with a lanyard that is mounted placed around the user's neck, with a retractor attached to the lanyard and hanging at the user's chest. The phone or other personal article can then be connected to line of the retractor. For both the above, when the user wishes to operate the personal-article, the line from the retractor can be extended to the desired length for use of the personal article by pulling on the personal article. Once the user is done using the personal article, the pulling force can be released, so that the retractor line is retracted into the retractor housing, and the personal article is held adjacent to the retractor housing.

One disadvantage of this arrangement is that the personal article will often times hang out of alignment with the retractor housing. That is, when the personal, article is retracted by the retractor the personal article will not lay flat in alignment with the retractor and can dangle in relation to the retractor when the user moves. This can be both uncomfortable for the user, and can also result in damage to the personal article or the user's clothing under the personal article. As the user moves, the personal article can also move to different angles or may move away from the refractor housing.

SUMMARY OF THE INVENTION

The present invention generally directed to a connector and retractor system that provides a unique way of connecting a personal article to a retractor. The retractor can include a line connected to the personal article, and the connector system includes magnets that encourage the desired alignment of the personal article with the retractor when the line is retracted, and the personal article is adjacent the retractor. In some embodiments, the magnet arrangement aligns the personal article and the retractor, but in other embodiments the magnets can result in the personal article at an angle relative to the retractor.

Some embodiments of a connector and retractor system according to the present invention can comprise a retractor housing and a line within the retractor housing. The housing also has a hole from which the line extends, and a spring within the retractor housing which urges retraction of the line. A personal article can be attached to said line. A connector is included, between the retractor housing and the personal article, with the connector having magnets to cause alignment of the personal article with the retractor housing when the personal, article is retracted, to the housing.

The systems according to the present invention can comprise many different features as described below. These and other aspects and advantages of the invention will become apparent from the following detailed description and the accompanying drawings which illustrate by way of example the features of the invention.

DETAILED DESCRIPTION OF THE INVENTION

Figure 1:
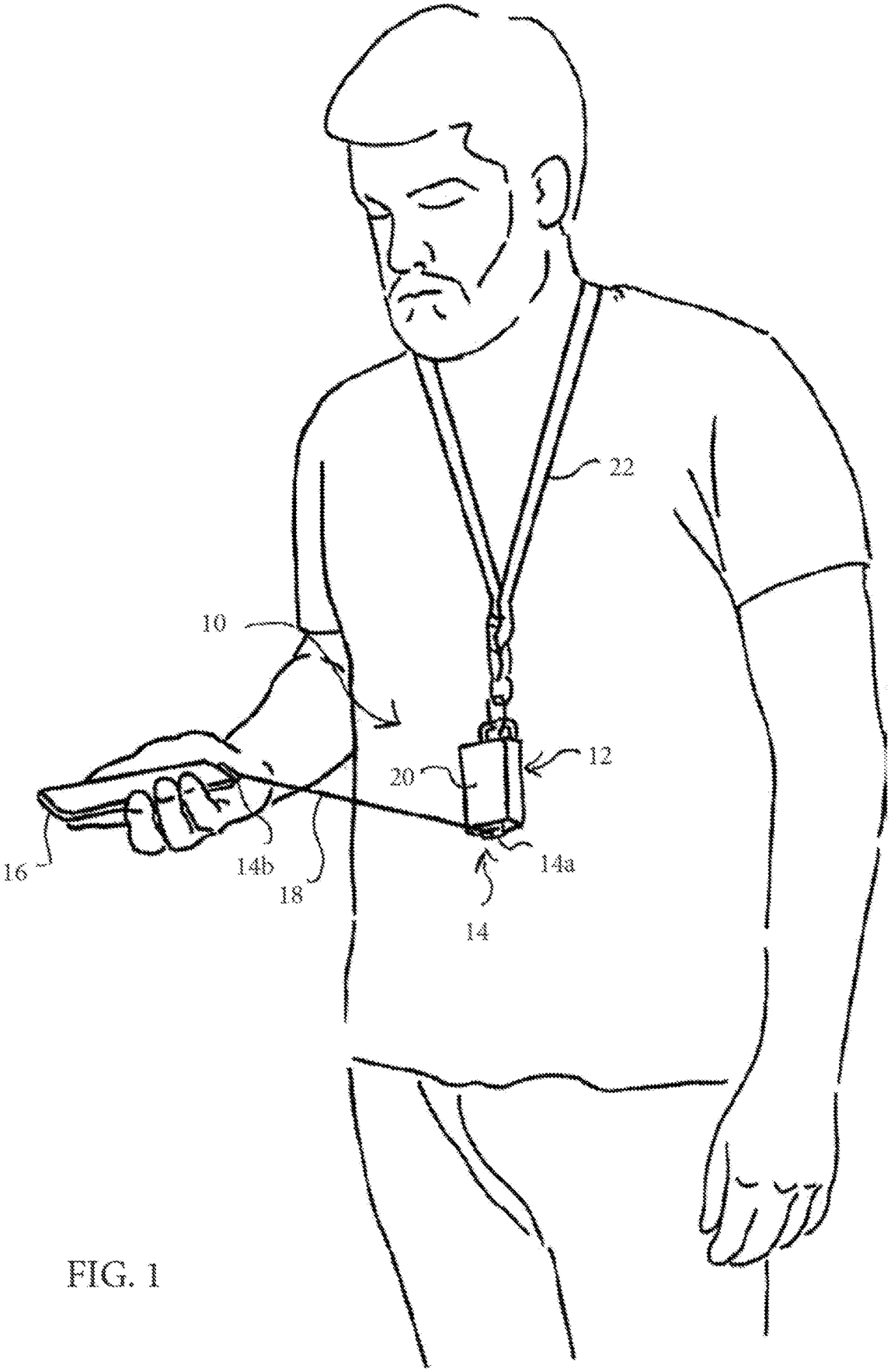
FIG. 1 is a front perspective view of one embodiment retractor according to the present invention hanging around a user's neck by a lanyard.

The present invention is directed to different retractor and personal article connection systems that have unique arrangements that encourage alignment of the personal article to the retractor. In the embodiments described herein, the retractor includes a line that is urged by an internal spring to be retracted into the retractor housing. The end of the line is connected to a personal article through a connector system. The connector system comprises a second part mounted or connected to the personal article and a first part mounted to or connected to the retractor housing. The line can be connected to the second part so that the personal article is attached to the line.

The retractor can be mounted to a user using different mechanisms such as a lanyard, clip or loop and can be mounted at many different locations on the user. When the user wants to operate the personal article, the user can pull the personal article away from the retractor thereby extending the line from the retractor housing the desired distance. When the user is done using the personal article, the user can remove or lessen the pulling force, which in turn allows the retractor's internal spring to retract the line. This results in the personal article being pulled toward the retractor.

In embodiments according to the present invention, retractor system can include devices or mechanisms to encourage alignment of the personal article and retractor when the line is fully retracted, and the personal article is adjacent the retractor. In some embodiments, these alignment devices and mechanisms can comprise magnets to encourage alignment. In some embodiments, the first and second connector parts can include multiple magnets that cooperate to encourage this alignment.

The present invention is described herein with reference to certain embodiments, but it is understood that the invention can be embodied in many different forms and should not be construed as limited to the embodiments set forth herein. It is further understood that different embodiments can comprise different materials arranged in different ways, and can comprise different features. Different embodiments can also be arranged for mounting to other locations other than a directly to a user.

It will be understood that when an element is referred to as being "on" or "connected to" another element, it can be directly on, or in contact with the other element or intervening elements may be present. In contrast, when an element is referred to as being "directly on", or "directly connected to" another element, there are no intervening elements present. Although the terms first, second, etc. may be used herein to describe various elements, and/or sections, these elements and/or sections should not be limited by these terms. These terms are only used to distinguish one element, or section from another element, or section. Thus, a first element or section discussed herein could be termed a second element, or section without departing from the teachings of the present invention.

Embodiments of the invention are described herein with reference to perspective view illustrations that are schematic illustrations of an embodiment of the invention. As such, the actual thickness or size of components can be different, and variations from the shapes of the illustrations as a result, for example, of manufacturing techniques and/or tolerances are expected. Embodiments of the invention should not be construed as limited to the particular shapes as illustrated herein but are to include deviations in shapes that result, for example, from manufacturing. A region or element illustrated or described as being generally square or rectangular can have rounded or curved features due to normal manufacturing tolerances. Thus, the features illustrated in the figures are schematic in nature and their shapes are not intended to illustrate the precise shape of a feature of a device and are not intended to limit the scope of the invention.

Figure 2:
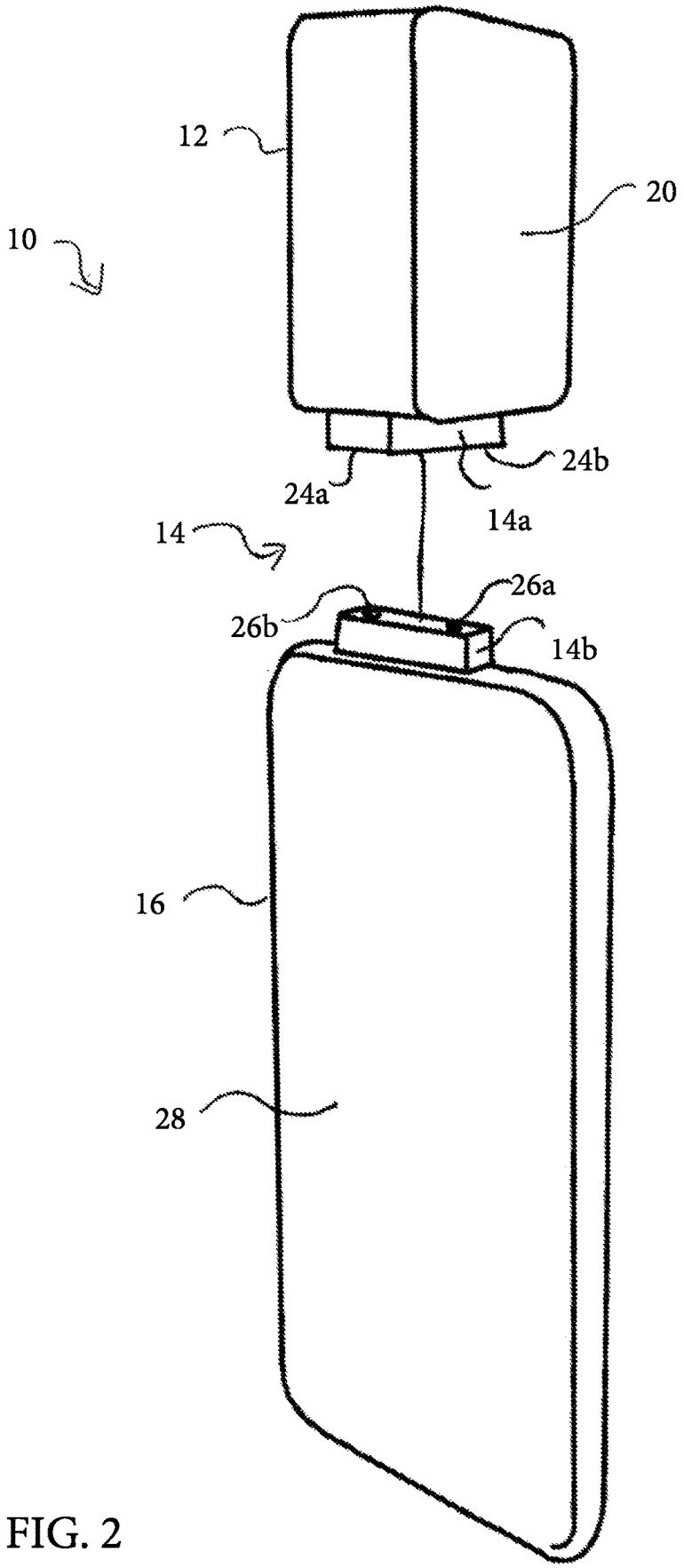
FIG. 2 is a front perspective view and a retractor according to the present invention arranged with a personal article.

FIGS. 1 and 2 show one embodiment of a retractor and connector system 10 according to the present invention that comprises a retractor 12 and a connector 14 having first and second connector parts 14*a*, 14*b*. The first connector part 14*a* is mounted to or is integral to the retractor 12, and the second connector part 14*b* is mounted to a personal article 16. The retractor includes a line 18 that can extend from the retractor housing 20. The line 18 can be connected to personal article 16 such that when the user pulls the personal article 16 away from the retractor 12, the line extends away from the retractor housing 20 against the retraction force of an internal retractor spring. In the embodiment shown, the line 18 can be connected to the second connector part 14*b*, but it is understood that in other embodiments the line 18 can be connected in other ways and to other locations on the personal article 16.

In the embodiment shown, the retractor 12 hangs around the neck of a user by a lanyard 22. It is understood, however, that the retractor can be mounted to the user in many different locations and by many other means and mechanisms, including but not limited to, belt loops, clamps, hooks, pouches, etc. In the embodiment shown, the personal article is shown as a cell phone, but it is understood that the present invention can be used with many other personal articles, such as scanner, security entry device, firearm, etc.

The first and second connector parts 14*a*, 14*b* can be mounted in place using many different methods and materials, such as adhesives, screws, clamps, etc. In still other embodiments, the first and second parts can be molded as part of the retractor housing or personal article.

Figure 3:
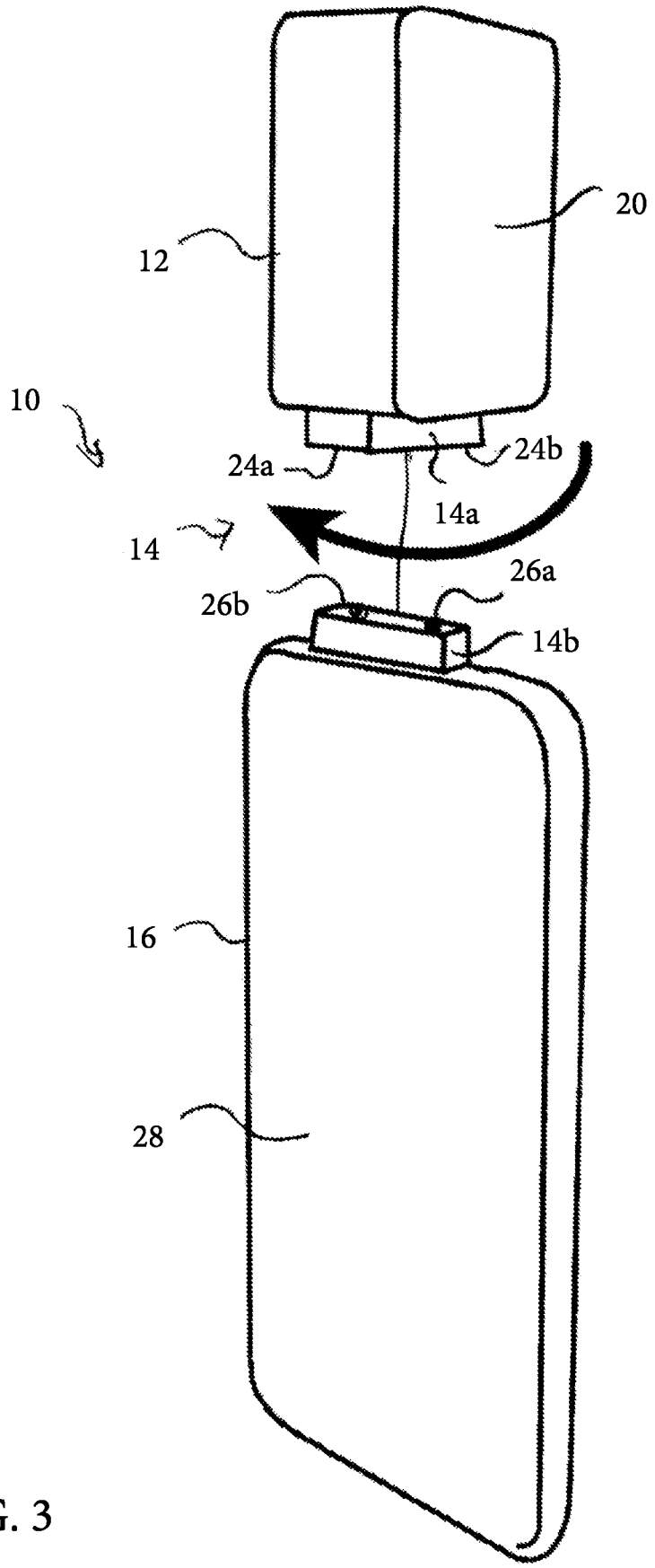
FIG. 3 is a front perspective view of the retractor shown in FIG. 2.
Figure 4:
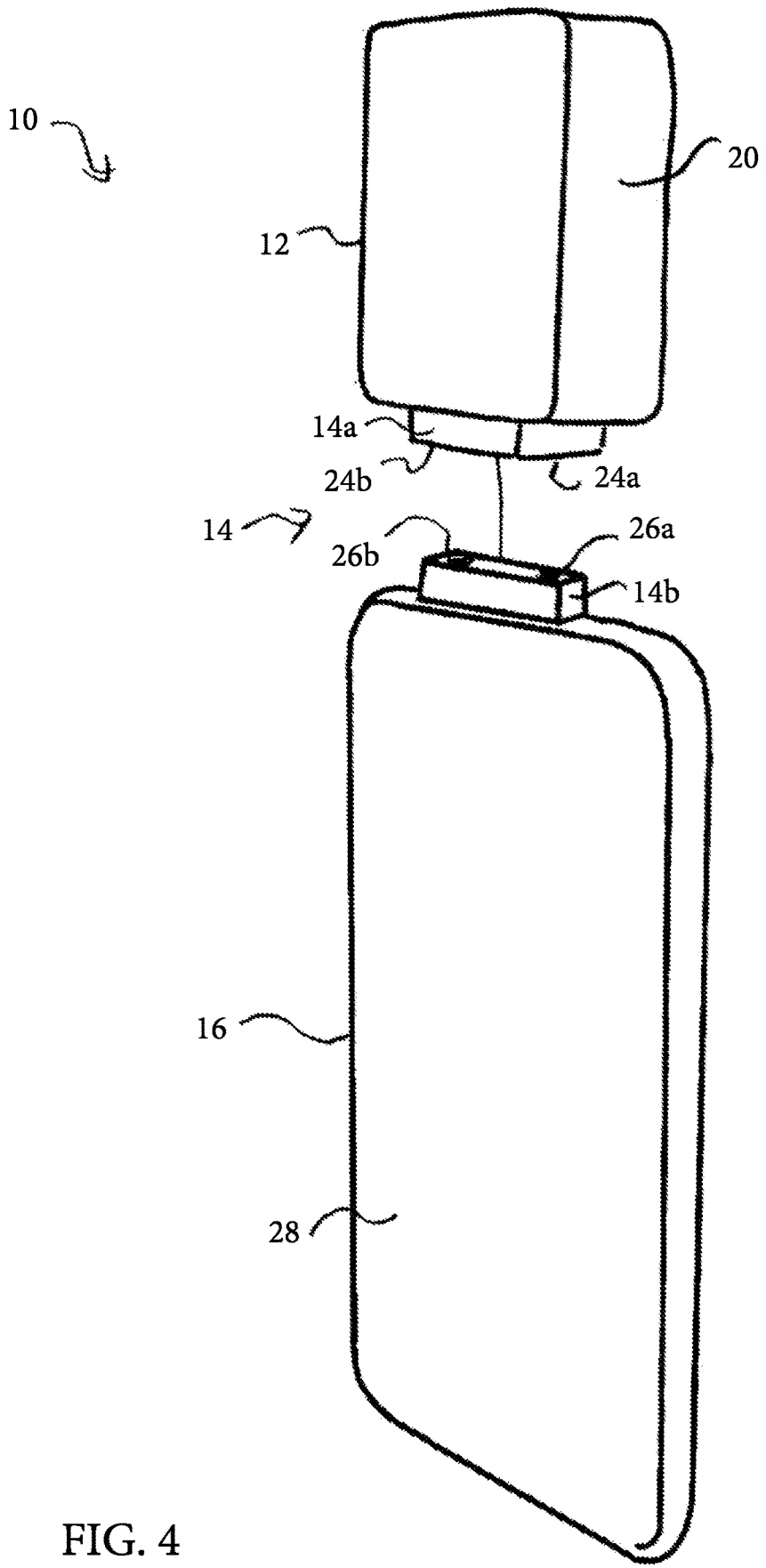
FIG. 4 is another front perspective view of plan view of the retractor shown in FIG. 2.
Figure 5:
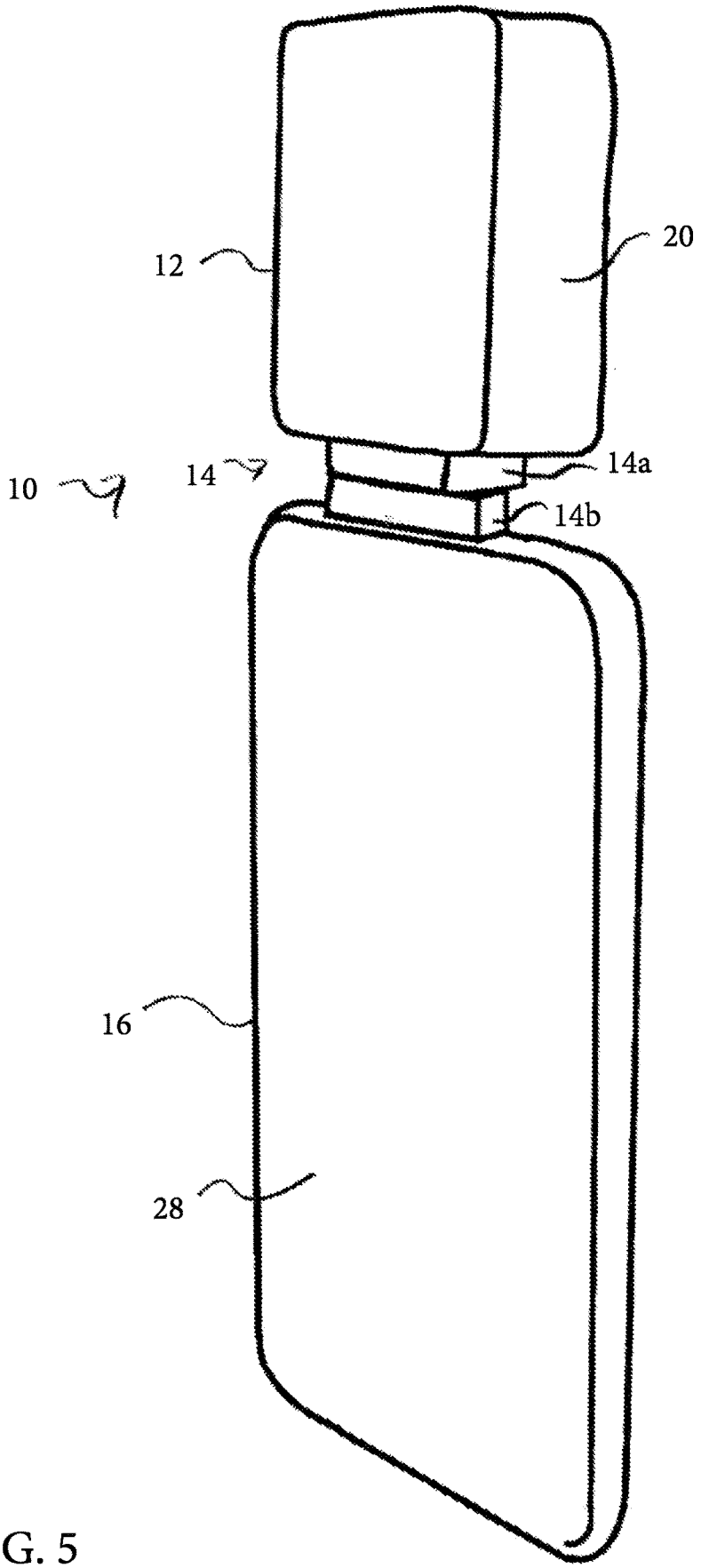
FIG. 5 is another front perspective view of the retractor shown in FIG. 2.

Referring now to FIGS. 3-5, the retainer and connector system 100 is shown with the retractor 12, connector 14, personal article 16, line 18 and retractor housing 20. As discussed above, one problem with conventional retractors is that when the line retracts the personal article when not in use, the article can hang at different angles in relation to the retractor or can dangle in relation to the retractor when the user moves. This can not only be uncomfortable for the user, but can result in damage to the personal article or the user's clothing.

The retractor and connector systems according to the present invention are arranged to encourage alignment of the personal article and the retractor when the line is retracted back into the retractor housing. This can be accomplished using many different mechanisms arranged in many different ways. Referring again to FIGS. 3-5, the first and second connector parts 14*a*, 14*b* can be arranged with multiple magnets to encourage this alignment. First connector part 14*a*, can include first and second retractor magnets 24*a*, 24*b*, and second connector part 14*b* can have first and second article magnets 26*a*, 26*b*. For both the first and second connector parts 14*a*, 14*b* the two magnets can be arranged on opposite sides of the line 18 on opposing ends of the parts 14*a*, 14*b*. In the embodiments shown, the magnets are arranged so that first retractor magnet 24*a* is drawn to first article magnet 26*a*, and second retractor magnet 24*b* is drawn to second article magnet 26*b*. Referring now the FIGS. 3-5, this arrangement of the magnets encourages alignment of the personal article 16 with the retractor 12 as the line draws the personal article 16 to the retractor housing. The drawing force of the magnet pairs causes the personal article to rotate as the magnets pull toward the other magnet in the pair. As the first and second parts 14*a*, 14*b* come in contact the parts will be in alignment, which will cause the article 16 and retractor 12 to be in alignment.

Figure 6:
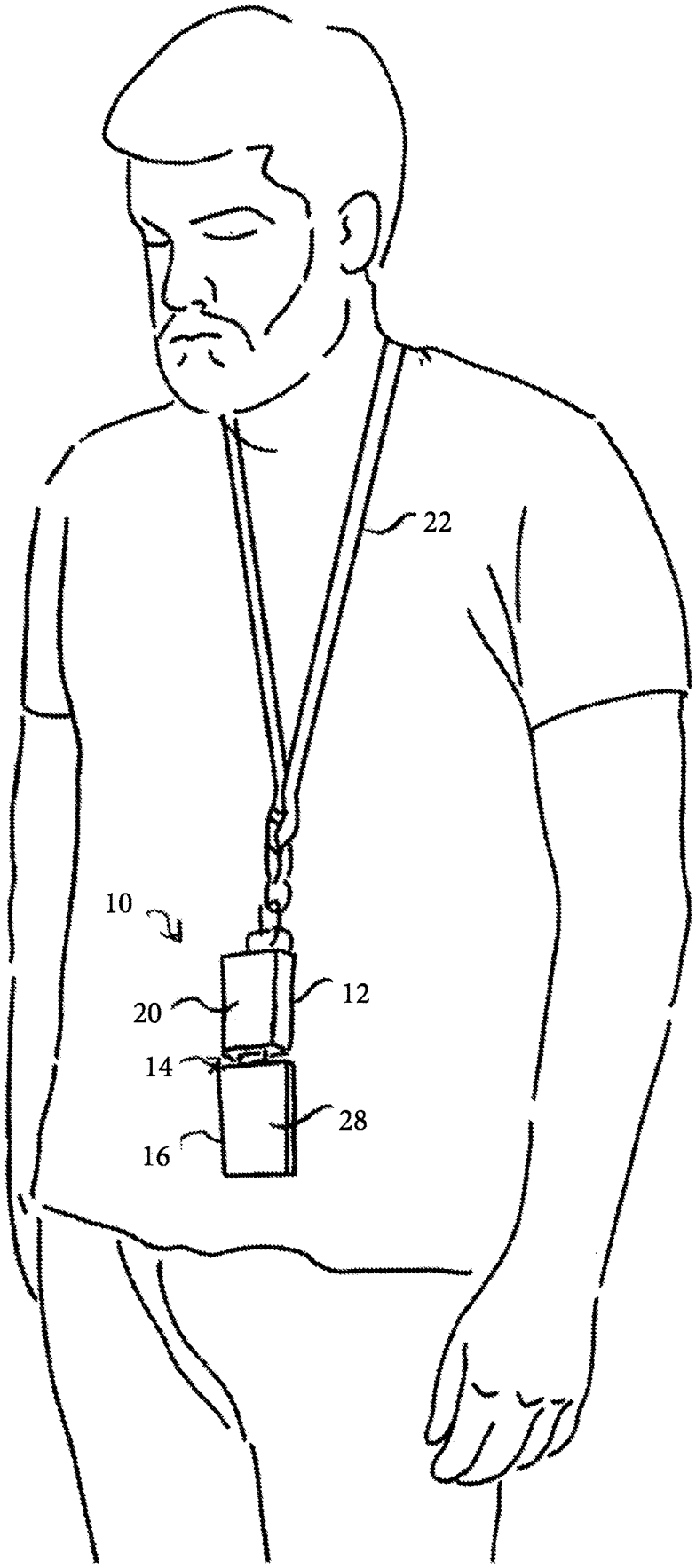
FIG. 6 is a front perspective view of one embodiment of retractor according to the present invention hanging around a user's neck by a lanyard.

This arrangement can also provide additional advantages. Referring now to FIG. 6, the personal article 16 is shown in its resting position with first and second connector parts 14*a*, 14*b* in alignment and contact. The magnet arrangement according to the present invention not only provides alignment of the personal article 16 and retractor 12, but it can result in alignment with the desired surface of the personal article being visible when in resting location. By way of example, in the embodiment shown the personal article 16 can comprise a cell phone with a display screen 28. The magnets can cause the personal article 16 to be drawn to the retractor 12 in an orientation so that the screen 28 is facing out and is visible by the user by looking down. This can allow the user to view information on the screen 28 without having to pull the article 16 away from the retractor 12. The user can also view the information on the screen by simply lifting the article 16 and retractor 12 as a unit, without pulling the article 16 away from the retractor 12. This can allow for more convenient use of the personal article 16 and can reduce wear on the retractor 12.

In the embodiments above, the magnets are shown and described as being in particular locations in the first and second parts 14*a*, 14*b*. It is understood that the magnets can be in different locations in the parts, on the retractor, and on the personal article. It is also understood that different embodiments can include fewer or more magnets than in the embodiments described herein.

Figure 7:
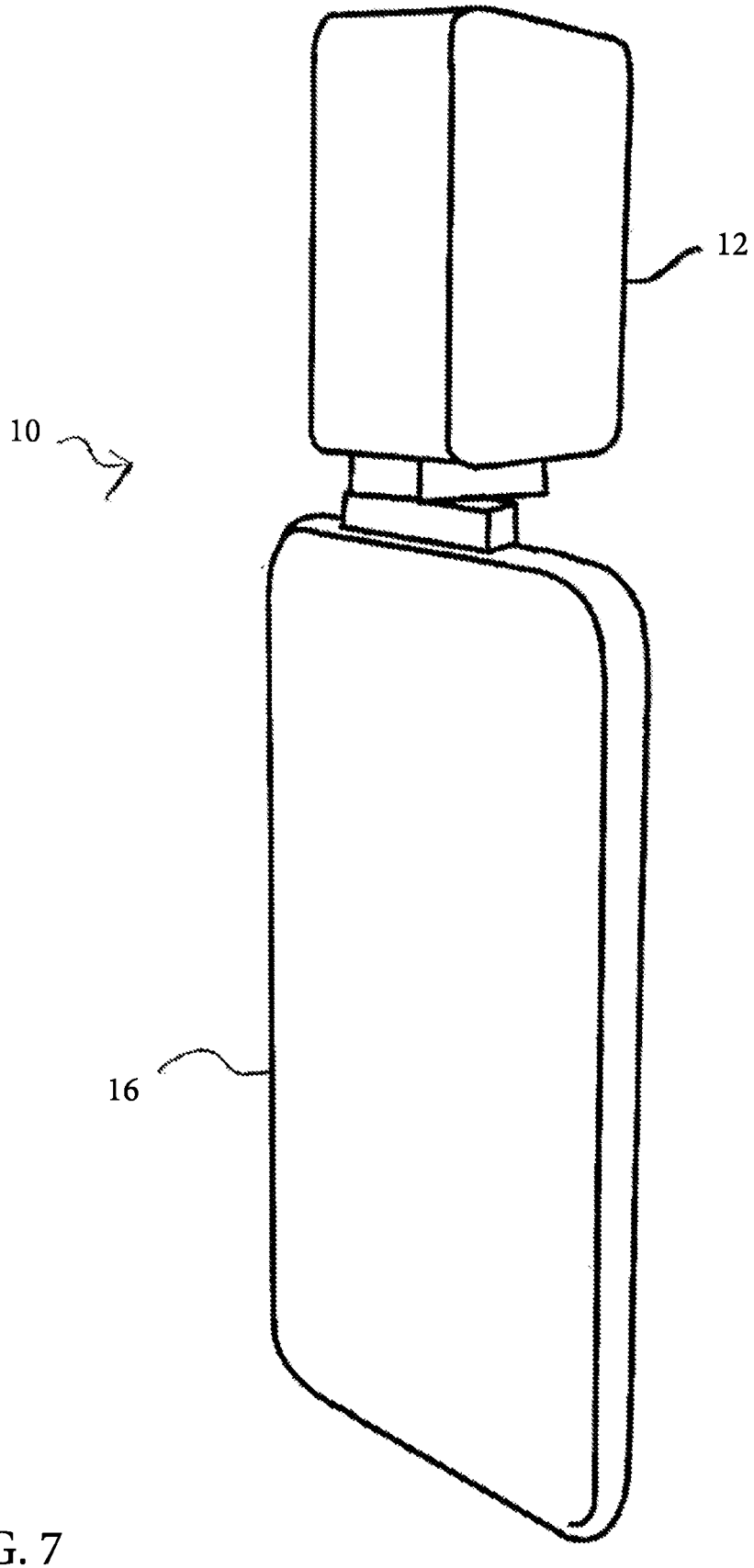
FIG. 7 is still another front perspective view of the retractor shown in FIG. 2.

In some embodiments, the magnets can provide a strong holding force that can be difficult to overcome to separate the article from the retractor. To make this separation easier, the article can be manipulated in different ways. Referring now to FIG. 7, the personal article 16 is shown in an orthogonal orientation relative to the retractor 12. This can be accomplished by rotating the article 16 in relation to the retractor 12, such as by hand. In this orientation, only one of the retractor magnets (described above) is engaged with an article magnet (described above). This essentially reduces the holding force between the article and the retractor, making them much easier to separate.

Figure 8:
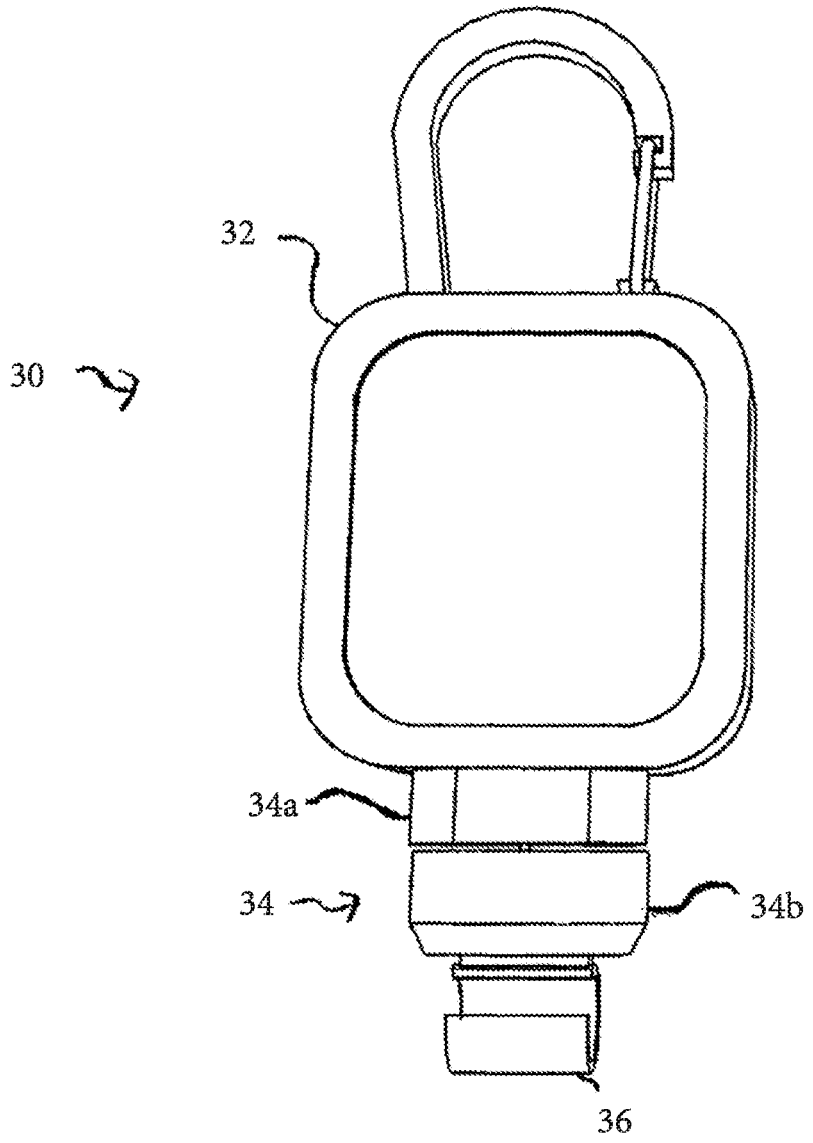
FIG. 8 is a front view of one embodiment of a retractor according to the present invention.

FIG. 8 shows another embodiment of a retractor can connector system 30 according to the present invention that is similar to the system 10 described above. It includes a retractor 32, and connector 34 having first and second connector parts 34*a*, 34*b*. The line (not shown) extends from the retractor housing 20 between the retractor 32 and the second connector part 34*b*, as described above. The first and second parts can be arranged with the magnets as described above to encourage alignment of the retractor 32 and the first and second connector parts 34*a*, 34*b*. In this embodiment, the second connector part 34*b* comprises clasp or hook type connecting mechanism 36 for connecting to a personal article (not shown). This is only one type of connecting mechanisms that can be used in the different embodiments of the present invention.

It is understood that many different mechanisms and arrangements can be used in the different systems according to the present invention. Although the present invention has been described in detail with reference to certain configurations thereof, other versions are possible. Therefore, the spirit and scope of the invention should not be limited to the versions described above.

We claim:

1. A connector and retractor system, comprising:

a retractor housing;

a lanyard. attached. to said retractor housing so that said. retractor housing hangs from the neck of a user and rests against the front of the user;

a line within said retractor housing, sad housing comprising a hole from which said line extends;

a spring within said housing which urges retraction of said line;

a personal article attached to said line, said personal article haring a display screen; and a connector between said retractor housing and said personal article, wherein said connector comprises a first connector portion on said retractor housing and a second connector on said personal article, said connector comprising magnets to cause alignment of said personal article with said retractor housing when said personal article is retracted to said housing by the urging of said spring, wherein said display screen. is visible to the user when looking down when said personal article is in said. retracted position, wherein said magnets comprise at least two magnets arranged on opposite sides of said line.

2. The system of claim 1, wherein said connector comprises first and second connector parts.

3. The system of claim 2, wherein said first connector part is on said retractor housing and said second connector part is on said personal article.

4. The system of claim 2, where said first connector part comprises two or more retractor magnets and said second connector part comprises two or more article magnets, wherein said retractor magnets cooperate with said article magnets to cause said. alignment of said personal article with said housing.

5. The system of claim 4, wherein each of said retractor magnets is arranged to cooperate with a respective one of said article magnets.

6. The system of claim 4, wherein each of said retractor magnets is drawn to respective one of said article magnets.

7. The system of claim 4, comprising two retractor magnets and two article magnets.

8. The system of claim 4 wherein said retractor magnets are around said hole and said article magnets are around the location where said personal article attaches to said line.

9. A connector and retractor system, comprising:

a retractor housing comprising a front surface;

a line within said retractor housing, said housing comprising a hole from which said line extends against a retraction force;

a personal attached to said line, wherein said personal article has a display screen; and a first connector part on said retractor housing and a second connector part on said personal article, wherein each of said first and second connector parts comprise two or more magnets to cause alignment of said personal article with said retractor housing when said line retracts said personal article such that said display screen is aligned with said retractor housing front surface when said personal article is retracted to said housing, wherein said magnets comprise at least two magnets arranged on opposite sides of said line, wherein at least two of said two or more magnets in said first connector part and at least two of said two or more magnets in said second connector part comprise at least two magnets arranged on opposite sides of said line.

10. The system of claim 9, where said first connector part comprises two or more retractor magnets and said second connector part comprises two or more article magnets, wherein each of said retractor magnets is arranged to cooperate with a respective one of said article magnets.

11. The system of claim 10, wherein each of said retractor magnets is drawn to respective one of said art magnets.

12. The system of claim 10, comprising two retractor magnets and two article magnets.

13. The system of claim 10, wherein said retractor magnets are around said hole and said article magnets are around the location where said personal article attaches to said line.

14. The system of claim 9, wherein said retractor housing comprises a mechanism for mounting to a user.

15. A connector and retractor system, comprising:

a retractor housing;

a mounting mechanism for mounting said retractor housing to a user a line within said retractor housing, said housing comprising a hole from which said line extends against a retraction force;

personal article attached to said line, said personal article having a display screen; and a first connector part on said retractor housing comprising first and second retractor magnets on opposing sides of said line, and a second connector part on said personal article comprising first and second article magnets on opposing sides of said line where it is attached to said personal article, wherein said retraction force causes retraction of said line and said personal article to said retractor housing, wherein said display screen is visible to the a sec when. said personal article is retracted.

16. The system of claim 15, wherein said retractor and article magnets cause alignment of said personal article with said retractor housing when said line retracts said personal article.

* * * * *